United States Patent [19]

Obata et al.

[11] Patent Number: 4,459,185

[45] Date of Patent: Jul. 10, 1984

[54] TIN, LEAD, AND TIN-LEAD ALLOY PLATING BATHS

[75] Inventors: Keigo Obata, Himeji; Nobuyasu Dohi, Kobe; Yoshiaki Okuhama, Kobe; Seishi Masaki, Kobe; Yukiyoshi Okada, Kobe; Masakazu Yoshimoto, Kobe, all of Japan

[73] Assignees: Obata, Doni, Daiwa, Fine Chemicals Co., Ltd.; Ishibara Chemical Co., Ltd., both of Hyogo, Japan

[21] Appl. No.: 532,934

[22] Filed: Sep. 16, 1983

[30] Foreign Application Priority Data

Oct. 8, 1982 [JP] Japan ..... 57-176365

[51] Int. Cl.[3] ..... C25D 3/32; C25D 3/36; C25D 3/56; C25D 3/60

[52] U.S. Cl. ..... 204/43 S; 204/53; 204/54 R

[58] Field of Search ..... 204/43 S, 53, 54 R, 204/114, 120, 123

[56] References Cited

U.S. PATENT DOCUMENTS

| | | | |
|---|---|---|---|
| 774,049 | 11/1904 | Diamant | 204/2.1 |
| 2,313,371 | 3/1943 | Stack et al. | 204/54 |
| 2,393,239 | 1/1946 | Deltz, Jr. | 204/120 |
| 3,905,878 | 9/1975 | Dohi et al. | 204/43 S |
| 4,132,610 | 1/1979 | Dohi et al. | 204/43 S |

FOREIGN PATENT DOCUMENTS

| | | | |
|---|---|---|---|
| 555929 | 9/1943 | United Kingdom | 204/54 R |
| 726218 | 4/1980 | U.S.S.R. | 204/54 R |

*Primary Examiner*—G. L. Kaplan
*Attorney, Agent, or Firm*—Seidel, Gonda & Goldhammer

[57] ABSTRACT

A tin, lead or tin-lead alloy plating bath, which comprises (A) a principal plating bath containing an alkanesulfonic or alkanolsulfonic acid, and either a divalent tin salt or a divalent lead salt thereof or both;

(B) at least one of surfactants comprising (a) a cationic surfactant selected from the group consisting of quarternary ammonium salts, alkyl pyridinium salts, alkyl imidazolinium salts and higher alkyl amine salts, (b) an amphoteric surfactant selected from betaines, or (c) a nonionic surfactant selected from the group consisting of condensation products of ethylene oxide and/or propylene oxide with a styrenated phenol, a higher alcohol, an alkylphenol, an alkylnaphthol, a fatty acid amide, a sorbitan or a phosphate; and (C) at least one of levelling agents selected from the group consisting of alkylidene sulfamic acids, quinolinol derivatives, benzotriazole derivatives, dialkylidene o-phenylene diamines, benzaldehyde derivatives, triazine derivatives, salicylic acid derivatives and nitriles.

26 Claims, No Drawings

TIN, LEAD, AND TIN-LEAD ALLOY PLATING BATHS

BACKGROUND OF THE INVENTION

1. Field of the Invention

This invention relates to tin, lead, and tin-lead alloy electroplating baths using an alkane- or alkanolsulfonic acid as an acid component commonly capable of forming a soluble complex salt with divalent tin and lead.

2. Description of the Prior Art

In recent years tin and tin-lead alloy platings have found extensive use in producing coatings to improve solderability or forming etching resist films on electrical and electronic parts and the like.

For industrial production, borofluoride baths are widely employed to permit high-speed, uniform metal plating of tin, lead, or tin-lead alloy. However, the borofluoride baths are so corrosive and toxic that the equipment is costly and many difficulties are involved in the equipment and operation, including the disposal of wastewater. Although these problems are solved somehow or other using a highly advanced technique for treating the borofluoride, it would mean a heavy expense with much economic loss.

SUMMARY OF THE INVENTION

The present invention provides tin, lead, and tin-lead alloy plating baths capable of giving uniform and dense deposits on substrate surfaces at high speed, without employing the borofluoric acid that often poses environmental pollution problems. The plating bath of the present invention is prepared by adding one or more certain cationic, amphoteric and/or nonionic surfactants and further adding one or more levelling agents to a principal plating bath containing an alkanesulfonic or alkanolsulfonic acid and either a divalent tin salt or a divalent lead salt thereof or both.

Additionally, the present invention provides a method of using the plating bath as described above.

DETAILED DESCRIPTION OF THE INVENTION

It has now been found that plating baths well comparable or even superior in performance to borofluoride baths and capable of giving uniform, dense tin, lead, or tin-lead alloy deposits at high speed under widely varied current conditions, from high to low current density ranges, can be obtained by using, instead of borofluoride ones, plating solutions composed essentially of a less pollutional alkane- or alkanolsulfonic acid and its tin and/or lead salt, with the addition of at least one each of certain surfactants and levelling agents.

Thus, the present invention is directed to a tin, lead, or tin-lead alloy plating bath prepared by adding one or more certain cationic, amphoteric and/or nonionic surfactants and further adding one or more levelling agents to a principal plating bath containing an alkanesulfonic or alkanolsulfonic acid and either a divalent tin salt or a divalent lead salt thereof or both.

The principal plating bath according to this invention consists basically of one or more alkane- or alkanolsulfonic acids and one or more tin salts or lead salts or both thereof.

The alkane- and alkanolsulfonic acids that may be employed have the following general formulas, respectively:

$$R—SO_3H$$

where R represents a $C_{1-12}$ alkyl group, and $$HO—R—SO_3H$$

where R signifies the same as above, and the hydroxyl group may be situated in any position with respect to the alkyl group.

Examples of such alkanesulfonic acids are methane-, ethane-, propane-, 2-propane-, butane-, 2-butane-, pentane-, hexane-, decane-, and dodecanesulfonic acids. These alkanesulfonic acids may be used singly or as a mixture of two or more.

Useful alkanolsulfonic acids include isethionic acid (2-hydroxyethane-1-sulfonic acid) and 2-hydroxypropane-1-, 1-hydroxypropane-2-, 3-hydroxypropane-1-, 2-hydroxybutane-1-, 4-hydroxybutane-1-, 2-hydroxypentane-1-, 2-hydroxyhexane-1-, 2-hydroxydecane-1-, and 2-hydroxydodecane-1-sulfonic acids. These hydroxy-containing alkanesulfonic acids may also be used singly or as a mixture of two or more.

In the case of tin plating, the bath contains an alkane- or alkanolsulfonic acid as described above and a tin salt thereof. Likewise, a lead plating bath contains such a sulfonic acid and a lead salt thereof, and a tin-lead alloy plating bath contains such a sulfonic acid and tin and lead salts thereof. The total concentration in term of metal of the tin salt and/or lead salt in the plating bath is desirably in the range from 0.5 to 200 g, preferably from 10 to 100 g, per liter of the bath. The concentration of the free alkane- or alkanolsulfonic acid to be present in the plating bath is at least stoichiometrically equivalent to the divalent tin and/or lead ions in the bath. The concentration of the free alkane- or alkanolsulfonic acid is in general in the range from 10 to 500 g, preferably from 50 to 200 g, per liter of the bath.

Surfactants

The surfactant to be added to the plating bath in accordance with the invention will not only improve the dispersibility of the bath but also ensures excellently adhesive, dense and smooth deposit. Especially, it has also been found that a cationic surfactant is markedly effective in preventing the dendrite growth in the high current region, whereas a nonionic surfactant improves the throwing power of the plating solution in the low current region. Under the invention the surfactants can be used singly or in combination depending on the current conditions to be adopted. For example, the combined use of the two different surfactants makes possible plating under a wide range of current conditions. Further, the use of a certain levelling agent as will be mentioned later, together with the surfactants, will produce a synergetic effect, rendering the invention applicable to all known plating techniques, including the barrel, rack, through-hole, and high-speed continuous plating methods.

The surfactants that have been found effective for the practice of the invention are (a) cationic surfactants selected from quaternary ammonium salts represented by the general formula I:

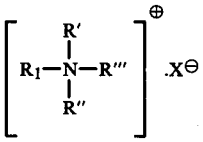

(I)

wherein X represents a halogen, a hydroxyl group, or the residue of a $C_{1-5}$ alkanesulfonic acid; $R_1$ represents a $C_{8-20}$ alkyl group; R′ and R″ represent a $C_{1-4}$ alkyl group; and R‴ represents a $C_{1-10}$ alkyl group or a benzyl group; pyridinium salts represented by the general formula II:

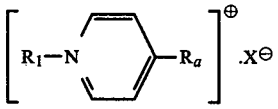

(II)

wherein X represents a halogen, a hydroxyl group, or the residue of a $C_{1-5}$ alkanesulfonic acid; $R_1$ represents a $C_{8-20}$ alkyl group; and $R_a$ represents hydrogen or a $C_{1-4}$ alkyl group;

imidazolinium salts represented by the general formula III:

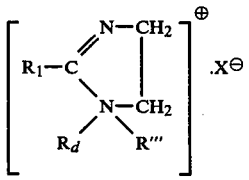

(III)

wherein X represents a halogen, a hydroxyl group, or the residue of a $C_{1-10}$ alkanesulfonic acid; $R_1$ represents a $C_{8-20}$ alkyl group; $R_d$ represents a hydroxy-containing $C_{1-5}$ alkyl group; and R‴ represents a $C_{1-10}$ alkyl group or a benzyl group; and higher alkyl amine salts represented by the general formula IV:

$$[R_1—NH_3]^{\oplus}.CH_3—(CH_2)_n—COO^{\ominus} \quad \text{(IV)}$$

wherein $R_1$ represents a $C_{8-20}$ alkyl group; and n stands for an integer of 0 to 4;

(b) amphoteric surfactants, especially betaines represented by the general formula V:

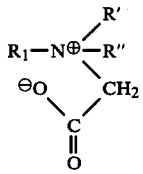

(V)

wherein $R_1$ represents a $C_{8-20}$ alkyl group; R′ and R″ represents a $C_{1-4}$ alkyl group; and (c) nonionic surfactants selected from condensation products of ethylene oxide and/or propylene oxide with a styrenated phenol represented by the general formula VI:

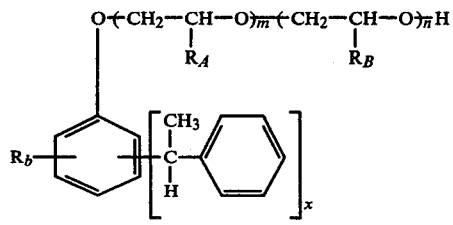

(VI)

wherein $R_A$ and $R_B$ represent hydrogen or —$CH_3$ with the proviso that $R_B$ represents —$CH_3$ when $R_A$ represents hydrogen, and vice versa; $R_b$ represents hydrogen, a $C_{1-4}$ alkyl or phenyl group; m is an integer of 1 to 25, preferably 1 to 20; n is an integer of 0 to 25, preferably 0 to 20; and x is an integer of 1 to 3;

condensation products of ethylene oxide and/or propylene oxides with a higher alcohol represented by the general formula VII:

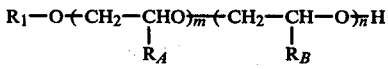

(VII)

wherein $R_1$ represents a $C_{8-20}$ alkyl group; and $R_A$, $R_B$, m and n have the meanings defined above;

condensation products of ethylene oxide and/or propylene oxide with an alkyl phenol represented by the general formula VIII:

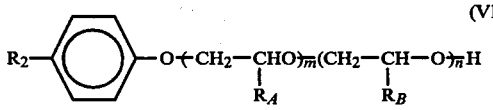

(VIII)

wherein $R_2$ represents a $C_{1-20}$ alkyl group; and $R_A$, $R_B$, m and n have the meanings defined above;

condensation products of ethylene oxide and/or propylene oxide with an alkyl naphthol represented by the general formula IX:

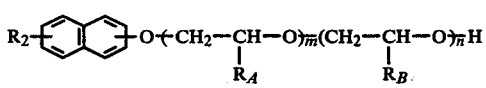

IX)

wherein $R_2$ represents a $C_{1-20}$ alkyl group; and $R_A$, $R_B$, m and n have the meanings defined above;

similar condensation products of ethylene oxide and/or propylene oxide with a $C_{3-22}$ fatty acid amide;

similar condensation products of ethylene oxide and/or propylene oxide with a sorbitan which is esterified with a $C_{8-22}$ higher fatty acid; and condensation product of ethylene oxide and/or propylene oxide with a phosphate represented by the general formula X:

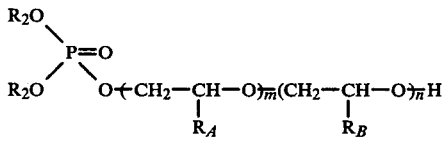

(X)

wherein $R_2$ represents a $C_{1-20}$ alkyl group, one of which may be hydrogen; and $R_A$, $R_B$, m and n have the meanings defined above.

The surfactants used in the present invention are products well know in the art.

Examples of the cationic surfactants, in the form of salts, are lauryltrimethylammonium salt, cetyltrimethylammonium salt, stearyltrimethylammonium salt, lauryldimethylethylammonium salt, octadecyldimethylethylammonium salt, dimethylbenzyllaurylammonium salt, cetyldimethylbenzylammonium salt, octadecyldimethylbenzylammonium salt, trimethylbenzylammonium salt, triethylbenzylammonium salt, hexadecylpyridinium salt, laurylpyridinium salt, dodecylpicolinium salt, 1-hydroxyethyl-1-benzyl-2-laurylimidazolinium salt, 1-hydroxyethyl-1-benzyl-2-oleylimidazolinium salt, stearylamine acetate, laurylamine acetate, and octadecylamine acetate.

Typical of the amphoteric surfactants are lauryldimethylammonium betaine and stearyldimethylammonium betaine.

The nonionic surfactants which can be used in the invention are prepared by condensing ethylene oxide and/or propylene oxide with a styrenated phenol, higher alcohol, alkylphenol, alkylnaphthol, esterified sorbitan, phosphate or fatty acid amide. The styrenated phenols preferably include mono-, di- or tri-styrenated phenol, mono- or di-styrenated cresol, mono- or di-styrenated phenylphenol. Typical of the higher alcohols are octanol, decanol, lauryl alcohol, tetradecanol, hexadecanol, stearyl alcohol, eicosanol, cetyl alcohol, oleyl alcohol and docosanol. Illustrative of the alkylphenols are mono-, di- or tri-alkyl substituted phenol such as p-tertiary-butylphenol, p-isooctylphenol, p-nonylphenol, p-hexylphenol, 2,4-dibutylphenol, 2,4,6-tributylphenol, p-dodecylphenol, p-laurylphenol and p-stearylphenol. The alkylnaphthols include alkylated $\alpha$ or $\beta$-naphthols. The alkyl substituent in the alkylnaphthols includes methyl, ethyl, propyl, butyl, hexyl, octyl, decyl, dodecyl and octadecyl, and may be in any position of the naphthalene nucleus. The fatty acid amide may be amides of propionic, butyric, caprylic, lauric, myristic, palmitic, stearic and behenic acids. The phosphates are esters obtained by esterifying one or two hydroxyl groups of phosphoric acid with a $C_{1-20}$ alcohol. Typical of the sorbitan esterified with a higher fatty acid are mono-, di- or tri-esterified 1,4-, 1,5- or 3,6-sorbitan, for example, sorbitan monolaurate, sorbitan monopalmitate, sorbitan monostearate, sorbitan oleate, sorbitan dilaurate, sorbitan dipalmitate, sorbitan distearate, sorbitan dioleate and mixed fatty acid esters of sorbitan.

Some of the nonionic surfactants, particularly those having both ethylene oxide units and propylene oxide units have a less tendency of bubbling in the plating bath. This property will facilitate the disposal of the waste plating solution.

As already stated, the cationic, amphoteric and nonionic surfactants may be used singly or in combination.

The surfactant is usually used in a concentration of 0.01–50 g, preferably 0.03–20 g, per liter of the bath in all.

Levelling Agents

To improve the smoothness of the plated surface, the plating solution according to the invention contains at least a certain levelling agent. The agent achieves a synergetic effect when used in combination with the aforementioned surfactant or surfactants. The levelling agents that have proved effective are those having the general formulas (A) through (H), i.e., alkylidene sulfamic or sulfanilic acid represented by the general formula A:

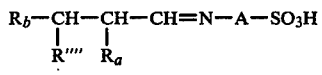

(A)

wherein $R_b$ represents hydrogen, a $C_{1-4}$ alkyl or phenyl group; R'''' represents hydrogen or a hydroxyl group; A represents a single bond or a phenylene group; and $R_a$ represents hydrogen or a $C_{1-4}$ alkyl group, quinolinol derivatives represented by the general formula B:

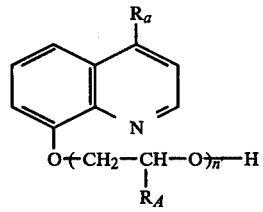

(B)

wherein $R_a$ represents hydrogen or a $C_{1-4}$ alkyl group; $R_A$ represents hydrogen or —$CH_3$; and n' is an integer of 2 to 15, benzotriazole derivatives represented by the general formula C:

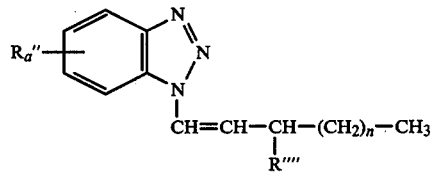

(C)

wherein $R''_a$ represents hydrogen, halogen or a $C_{1-4}$ alkyl group; R'''' represents hydrogen or a hydroxyl group; and n is an integer of 0 to 12, dialkylidene o-phenylene diamines represented by the general formula D:

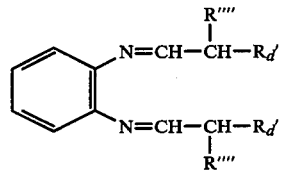

(D)

wherein R'''' represents hydrogen or a hydroxyl group; and $R'_d$ represents a $C_{1-5}$ alkyl or hydroxyl-containing $C_{1-5}$ alkyl group, benzaldehyde derivatives represented by the general formula E:

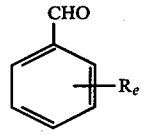

(E)

wherein $R_e$ represents a nitro, amino, or $C_{1-5}$ alkyl group, triazine derivatives represented by the general formula F:

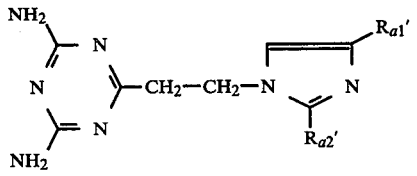

(F)

wherein $R'_{a1}$ represents hydrogen or a $C_{1-10}$ alkyl group and $R'_{a2}$ represents a $C_{1-18}$ alkyl group, salycilic acid derivatives represented by the general formula G:

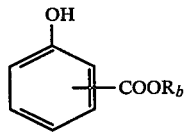

(G)

wherein $R_b$ represents hydrogen, a $C_{1-4}$ alkyl group, or a phenyl group, and nitriles represented by the general formula H:

$$R'_b—CH=CH—C\equiv N \quad (H)$$

wherein $R'_b$ represents hydrogen a, phenyl group, or a $C_{1-8}$ alkyl group.

Of these levelling agents, particularly desired are, e.g., N-(3-hydroxybutylidene)-p-sulfanilic acid, N-butylidene-sulfanilic acid, N-cinnamylidenesulfanilic acid, 4-propyl-8-quinolyl polyoxyethylene ether, 1-(3-hydroxybutene-1)-benzotriazole, N,N'-dibutylidene-o-phenylenediamine, N,N'-diisobutylidene-o-phenylenediamine, N,N'-di-(3-hydroxybutylidene)-o-phenylene-diamine, m-nitrobenzaldehyde, 2,4-diamino-6-{2'-methylimidazolyl(1')}-ethyl-1,3,5-triazine, 2,4-diamino-6-{2'-ethyl-4-methylimidazolyl(1')}-ethyl-1,3,5-triazine, 2,4-diamino-6-{2'-undecylimidazolyl(1')}-ethyl-1,3,5-triazine, phenyl salicylate, and styryl cyanide.

The levelling agent is used in a concentration of 0.01–30 g, preferably 0.03–5 g, per liter of the bath.

The concentration of the individual components of the plating bath according to the invention can be suitably chosen within the ranges specified, depending on the method of plating, such as barrel, rack, through-hole, or high-speed continuous plating. The operation may be at room temperature, although it is necessary to elevate the temperature to about 50°–60° C. for high-speed plating. The plating bath of the invention gives uniform, dense deposits in a wide current density range.

EXAMPLES

Several examples of the invention are given below to show the compositions of plating solutions and the conditions for plating. But it is to be noted that the invention is not limited thereto but the plating bath compositions and the plating conditions can be freely altered or modified within the aforesaid purposes of obtaining uniform, dense deposits on substrates at high speed in accordance with the invention.

The concentration of the metal salts in the plating baths in the following examples are expressed in term of metal.

Examples 1 to 13

The Hull Cell test was used to evaluate throwing powers of the plating solutions and the appearances of the deposits on the copper substrates. The results are given in Tables 1 to 3.

Example 1

(A)

| | |
|---|---|
| Divalent tin (in the form of stannous 2-hydroxypropane sulfonate) | 20 g/l |
| Free 2-hydroxypropane sulfonic acid | 100 g/l |
| Dimethyl benzyl lauryl ammonium chloride | 3 g/l |
| N—(3-hydroxybutylidene)-p-sulfanilic acid | 1 g/l |
| Temperature | 25° C. |
| Range of current density | 1–15 A/dm$^2$ |

(B)

Coconut aliphatic alkyl dimethyl benzyl ammonium chloride was substituted for dimethyl benzyl lauryl ammonium chloride. The other components and conditions were the same as those in (A).

Example 2

| | |
|---|---|
| Divalent tin (in the form of stannous methane sulfonate) | 100 g/l |
| Free methane sulfonic acid | 150 g/l |
| Cetyl dimethyl benzyl ammonium hydroxide | 5 g/l |
| N—butylidene sulfanilic acid | 2 g/l |
| Temperature | 35–40° C. |
| Range of current density | 5–40 A/dm$^2$ |

Example 3

(A)

| | |
|---|---|
| Divalent tin (in the form of stannous ethane sulfonate) | 20 g/l |
| Free ethane sulfonic acid | 100 g/l |
| Lauryl dimethyl ammonium betaine | 1 g/l |
| Nonionic surfactant (condensation product of one mole of styrenated phenol with 15 moles of ethylene oxide) | 10 g/l |
| N—cinnamoylidene sulfanilic acid | 2 g/l |
| Temperature | 25° C. |
| Range of current density | 0.5–15 A/dm$^2$ |

(B)

Octadecyl dimethyl ammonium betaine was substituted for lauryl dimethyl ammonium betaine. The other components and conditions were the same as those in (A).

Example 4

(A)

| | |
|---|---|
| Lead (in the form of lead 2-hydroxypropane sulfonate) | 20 g/l |
| Free 2-hydroxypropane sulfonic acid | 100 g/l |
| Dodecyl picolinium methane sulfonate | 5 g/l |
| N—(3-hydroxybutylidene)-p-sulfanilic acid | 1 g/l |
| Temperature | 25° C. |
| Range of current density | 1–10 A/dm$^2$ |

(B)

Cetyl pyridinium bromide was substituted for dodecyl picolinium methane sulfonate. The other components and conditions were the same as those in (A).

Example 5

(A)

| | |
|---|---|
| Lead (in the form of lead methane sulfonate | 30 g/l |
| Free methane sulfonic acid | 100 g/l |
| Dimethyl benzyl lauryl ammonium methane sulfonate | 5 g/l |
| Nonionic surfactant (condensation product of one mole of styrenated phenylphenol with 13 moles of ethylene oxide) | 5 g/l |
| N,N'—diisobutylidene-o-phenylene diamine | 0.5 g/l |
| Temperature | 30° C. |
| Range of current density | 1–20 A/dm$^2$ |

(B)

Coconut aliphatic alkyl dimethyl benzyl ammonium chloride was substituted for dimethyl benzyl lauryl ammonium methane sulfonate. The other components and conditions were the same as those in (A).

Example 6

| | |
|---|---|
| Divalent tin (in the form of stannous methane sulfonate) | 12 g/l |
| Lead (in the form of lead methane sulfonate) | 8 g/l |
| Free methane sulfonic acid | 100 g/l |
| Octadecyl dimethyl benzyl ammonium bromide | 1 g/l |
| Nonionic surfactant (condensation product of one mole of styrenated phenol with 15 moles of ethylene oxide) | 5 g/l |
| 1-(3-hydroxybutene-1) benzotriazole | 0.5 g/l |
| Temperature | 25° C. |
| Range of current density | 0.5–15 A/dm$^2$ |

Example 7

| | |
|---|---|
| Divalent tin (in the form of stannous 2-hydroxyethane sulfonate) | 18 g/l |
| Lead (in the form of lead 2-hydroxyethane sulfonate) | 12 g/l |
| Free 2-hydroxyethane sulfonic acid | 150 g/l |
| Nonionic surfactant (condensation product of one mole of styrenated phenol with 15 moles of propylene oxide) | 7 g/l |
| 4-propyl-8-quinolyl polyoxyethene ether | 2 g/l |
| Temperature | 25° C. |
| Range of current density | 0.5–10 A/dm$^2$ |

Example 8

| | |
|---|---|
| Divalent tin (in the form of stannous 2-hydroxypropane sulfonate) | 9 g/l |
| Lead (in the form of lead 2-hydroxypropane sulfonate) | 1 g/l |
| Free 2-hydroxypropane sulfonic acid | 100 g/l |
| Nonionic surfactant (condensation product of one mole of styrenated phenol with 20 moles of propylene oxide) | 5 g/l |
| N—(3-hydroxybutylidene)-p-sulfanilic acid | 0.3 g/l |
| Temperature | 25° C. |
| Range of current density | 0.5–5 A/dm$^2$ |

Example 9

| | |
|---|---|
| Divalent tin (in the form of stannous 2-hydroxypropane sulfonate) | 12 g/l |
| Lead (in the form of lead 2-hydroxypropane sulfonate) | 8 g/l |
| Free 2-hydroxypropane sulfonic acid | 100 g/l |
| Nonionic surfactant ("EPAN 750") | 5 g/l |
| N,N'—diisobutylidene-o-phenylene diamine | 1 g/l |
| Temperature | 25° C. |
| Range of current density | 0.5–10 A/dm$^2$ |

Example 10

| | |
|---|---|
| Divalent tin (in the form of stannous methane sulfonate) | 20 g/l |
| Free methane sulfonic acid | 100 g/l |
| Nonionic surfactant ("LIPONOX N—105") | 5 g/l |
| 2,4-diamino-6-[2'-undecylimidazolyl-(1')] ethyl-1,3,5-triazine | 0.5 g/l |
| Temperature | 25° C. |
| Range of current density | 0.5–15 A/dm$^2$ |

Example 11

| | |
|---|---|
| Lead (in the form of lead 2-hydroxyethane sulfonate) | 20 g/l |
| Free 2-hydroxyethane sulfonic acid | 150 g/l |
| Nonionic sulfactant (condensation product of one mole of styrenated phenol with 15 moles of ethylene oxide) | 5 g/l |
| Styryl cyanide | 0.5 g/l |
| Temperature | 30° C. |
| Range of current density | 1–10 A/dm$^2$ |

Example 12

| | |
|---|---|
| Divalent tin (in the form of stannous methane sulfonate) | 18 g/l |
| Lead (in the form of lead methane sulfonate) | 12 g/l |
| Free methane sulfonic acid | 150 g/l |
| Nonionic surfactant ("NDYGEN EN") | 3 g/l |
| Phenyl salicylate | 0.5 g/l |
| Temperature | 25° C. |
| Range of current density | 0.5–20 A/dm$^2$ |

Example 13

| | |
|---|---|
| Divalent tin (in the form of stannous 2-hydroxypropane sulfonate) | 40 g/l |
| Free 2-hydroxypropane sulfonic acid | 200 g/l |
| Dimethyl benzyl lauryl ammonium methane sulfonate | 7 g/l |
| m-Nitrobenzaldehyde | 2 g/l |
| Temperature | 30° C. |
| Range of current density | 2–25 A/dm$^2$ |

The results obtained for the tin-plating are given in Table 1.

TABLE 1

| Examples No. | Hull Cell Test | | | |
|---|---|---|---|---|
| | Throwing power | | Appearance | |
| | 0.1A - 2 min. | 1A - 5 min. | 1A - 5 min. | 2A - 2.5 min. |
| 1 (A) | Δ | O | ◉ | O |
| (B) | Δ | O | ◉ | ◉ |
| 2 | Δ | O | ◉ | ◉ |

TABLE 1-continued

| | | | | |
|---|---|---|---|---|
| 3 (A) | ◉ | ◉ | O | O |
| (B) | ◉ | ◉ | O | O |
| 10 | O | ◉ | O | O |
| 13 | Δ | O | O | ◉ |
| Control A* | x | x | Δ | Δ |

◉ excellent, O: good, Δ: permissible,
x: unsatisfactory
*The composition of Control A:

| | |
|---|---|
| Divalent tin (in the form of stannous methane sulfonate) | 20 g/l |
| Free methane sulfonic acid | 100 g/l |
| Dimethyl benzyl lauryl ammonium chloride | 5 g/l |

The results obtained for the lead-plating are shown in Table 2.

TABLE 2

| | Hull Cell Test | | | |
|---|---|---|---|---|
| | Throwing power | | Appearance | |
| Examples No. | 0.1A - 2 min. | 1A - 5 min. | 1A - 5 min. | 2A - 2.5 min. |
| 4 (A) | Δ | O | ◉ | ◉ |
| (B) | Δ | O | O | ◉ |
| 5 (A) | ◉ | O | O | O |
| (B) | ◉ | O | O | O |
| 11 | O | O | O | Δ |
| Control B* | Δ | Δ | x | x |

◉: excellent, O: good, Δ: permissible,
x: unsatisfactory
*The composition of Control B:

| | |
|---|---|
| Lead (in the form of lead 2-hydroxypropane sulfonate) | 20 g/l |
| Free 2-hydroxypropane sulfonic acid | 100 g/l |
| Nonionic surfactant ("EPAN 750") | 3 g/l |

The results obtained for the tin-lead alloy-plating are given in Table 3.

TABLE 3

| | Hull Cell Test | | | |
|---|---|---|---|---|
| | Throwing power | | Appearance | |
| Examples No. | 0.1A - 2 min. | 1A - 5 min. | 1A - 5 min. | 2A - 2.5 min. |
| 6 | ◉ | ◉ | ◉ | O |
| 7 | ◉ | ◉ | ◉ | O |
| 8 | O | O | O | |
| 9 | ◉ | ◉ | O | O |
| 12 | O | O | O | Δ |
| Control C* | X | X | Δ | Δ |

◉ excellent, O: good, Δ: permissible,
X: unsatisfactory
*The composition of Control C:

| | |
|---|---|
| Divalent tin (in the form of stannous methane sulfonate) | 12 g/l |
| Lead (in the form of lead methane sulfonate) | 8 g/l |
| Free methane sulfonic acid | 100 g/l |
| Hexadecyl pyridinium methane sulfonate | 5 g/l |

Examples 14 to 25

In the following examples the throwing powers of the plating solutions and the appearance of the deposits on the copper substrates were evaluated by the Hull Cell Test. Also, the bubbling test for the plating solutions was carried out. The results are given in Table 4.

Examples 14

| | |
|---|---|
| Divalent tin (in the form of stannous 2-hydroxypropane sulfonate) | 20 g/l |
| Free 2-hydroxypropane sulfonic acid | 100 g/l |
| Product prepared by condensing one mole of lauryl alcohol with 7 moles of ethylene oxide and then with 5 mole of propylene oxide | 5 g/l |
| N—(3-hydroxybutylidene)-p-sulfanilic acid | 0.5 g/l |
| Temperature | 25° C. |
| Range of current density | 1–10 A/dm$^2$ |

Examples 15

| | |
|---|---|
| Divalent tin (in the form of stannous methane sulfonate) | 100 g/l |
| Free methane sulfonic acid | 120 g/l |
| Product prepared by condensing one mole of 2,4,6-tristyrenated phenol with 14 moles of ethylene oxide and then with 10 moles of propylene oxide | 7.5 g/l |
| N—(3-hydroxybutylidene)-p-sulfanilic acid | 0.5 g/l |
| Temperature | 35° C. |
| Range of current density | 5–40 A/dm$^2$ |

Example 16

| | |
|---|---|
| Divalent tin (in the form of stannous 2-hydroxypropane sulfonate) | 40 g/l |
| Free 2-hydroxypropane sulfonic acid | 120 g/l |
| Product prepared by condensing one mole of 2,4,6-tristyrenated phenol with 2 moles of propylene oxide and then with 5 moles of ethylene oxide | 2 g/l |
| N—(3-hydroxybutylidene)-p-sulfanilic acid | 0.5 g/l |
| Temperature | 25° C. |
| Range of current density | 0.1–15 A/dm$^2$ |

Example 17

| | |
|---|---|
| Divalent tin (in the form of stannous ethane sulfonate) | 20 g/l |
| Free ethane sulfonic acid | 100 g/l |
| Product prepared by condensing one mole of 2,4,6-tristyrenated phenol with 2 moles of propylene oxide and then with 10 moles of ethylene oxide | 2 g/l |
| 2,4-Diamino-6-[2'-undecylimidazolyl(1')] ethyl-1,3,5-triazine | 2 g/l |
| Temperature | 40° C. |
| Range of current density | 5–20 A/dm$^2$ |

Example 18

| | |
|---|---|
| Divalent tin (in the form of stannous 2-hydroxyethane sulfonate) | 80 g/l |
| Free 2-hydroxyethane sulfonic acid | 120 g/l |
| Product prepared by condensing one mole of pendadecylamide with 7 moles of ethylene oxide and then with 10 moles of propylene oxide | 7.5 g/l |
| N,N'—diisobutylidene-o-phenylene diamine | 0.5 g/l |
| 1-(3-hydroxybutene-1)benzotriazole | 0.1 g/l |
| Temperature | 30° C. |
| Range current density | 5–30 A/dm$^2$ |

Example 19

| | |
|---|---|
| Divalent tin (in the form of stannous 2-hydroxypropane sulfonate) | 60 g/l |
| Free 2-hydroxypropane sulfonic acid | 150 g/l |
| Product prepared by condensing one mole of 4-styrenated phenol with 7 moles of ethylene | 3 g/l |

-continued

| | |
|---|---|
| oxide and then with 10 moles of propylene oxide | |
| Product prepared by condensing one mole of 2,4-distyrenated phenol with 7 moles of ethylene oxide and then with 10 moles of propylene oxide | 3 g/l |
| Product prepared by condensing one mole of 2,4,6-tristyrenated phenol with 7 moles of ethylene oxide and then with 10 moles of propylene oxide | 3 g/l |
| N—(3-hydroxybutylidene)-p-sulfanilic acid | 0.1 g/l |
| 2,4-diamino-6-[2'-undecylimidazolyl(1')] ethyl-1,3,5-triazine | 2 g/l |
| Temperature | 30° C. |
| Range of current density | 5–40 A/dm$^2$ |

Example 20

| | |
|---|---|
| Lead (in the form of lead 2-hydroxypropane sulfonate) | 20 g/l |
| Free 2-hydroxypropane sulfonic acid | 100 g/l |
| Product prepared by condensing one mole of stearyl alcohol with 2 moles of propylene oxide and then with 10 moles of ethylene oxide | 1 g/l |
| N,N'—diisobutylidene-o-phenylene diamine | 2 g/l |
| Temperature | 40° C. |
| Range of current density | 1–40 A/dm$^2$ |

Example 21

| | |
|---|---|
| Lead (in the form of lead methane sulfonate) | 10 g/l |
| Free methane sulfonic acid | 100 g/l |
| Product prepared by condensing one mole of p-nonylphenol with 10 moles of ethylene oxide and then 15 moles of propylene oxide | 5 g/l |
| 1-(3-hydroxybutene-1) benzotriazole | 0.5 g/l |
| Temperature | 25° C. |
| Range of current density | 1–20 A/dm$^2$ |

Example 22

| | |
|---|---|
| Lead (in the form of lead 2-hydroxyethane sulfonate) | 20 g/l |
| Free 2-hydroxyethane sulfonic acid | 150 g/l |
| Product prepared by condensing one mole of sorbitan monostearate with 4 moles of ethylene oxide and then with 2 moles of propylene oxide | 3 g/l |
| Product prepared by condensing one mole of p-isooctylphenol with 8 moles of ethylene oxide and then with 15 moles of propylene oxide | 3 g/l |
| 2,4-diamino-6-[2'-undecylimidazolyl(1')] ethyl-1,3,5-triazine | 1 g/l |
| Temperature | 30° C. |
| Range of current density | 1–15 A/dm$^2$ |

Example 23

| | |
|---|---|
| Divalent tin (in the form of stannous 2-hydroxypropane sulfonate) | 12 g/l |
| Lead (in the form of lead 2-hydroxypropane sulfonate) | 8 g/l |
| Free 2-hydroxypropane sulfonic acid | 100 g/l |
| Product prepared by condensing one mole of 2,4,6-tristyrenated phenol with 7 moles of ethylene oxide and then with 5 moles of propylene oxide | 5 g/l |
| 1-(3-hydroxybutene-1) benzotriazole | 0.5 g/l |

-continued

| | |
|---|---|
| 2,4-diamino-6-[2'-undecylimidazolyl(1')] ethyl-1,3,5-triazine | 3 g/l |
| Temperature | 20° C. |
| Range of current density | 0.1–10 A/dm$^2$ |

Example 24

| | |
|---|---|
| Divalent tin (in the form of stannous methane sulfonate) | 18 g/l |
| Lead (in the form of lead methane sulfonate) | 12 g/l |
| Free methane sulfonic acid | 150 g/l |
| Product prepared by condensing one mole of 6-ethylnaphthol with 10 moles of ethylene oxide and then with 2 moles of propylene oxide | 2 g/l |
| Product prepared by condensing one mole of undecylamide with 2 moles of propylene oxide and then with 5 moles of ethylene oxide | 2 g/l |
| N—(3-hydroxybutylidene)-p-sulfanilic acid | 0.1 g/l |
| Temperature | 25° C. |
| Range of current density | 1–10 A/dm$^2$ |

Example 25

| | |
|---|---|
| Divalent tin (in the form of stannous 2-hydroxypropane sulfonate) | 12 g/l |
| Lead (in the form of lead 2-hydroxypropane sulfonate) | 8 g/l |
| Free 2-hydroxypropane sulfonic acid | 200 g/l |
| Product prepared by condensing "GAFAC-RS710" (condensation product of phosphoric acid diester and ethylene oxide, manufactured by Toho Chemical Co., Ltd.) with 6 moles of propylene oxide | 5 g/l |
| 1-(3-hydroxybutene-1) benzotriazole | 0.2 g/l |
| Temperature | 20° C. |
| Range of current density | 1–15 A/dm$^2$ |

The results obtained in the above examples are given in Table 4.

TABLE 4

| Examples No. | Hull Cell Test: Throwing power 0.1A - 2 min. | Throwing power 1A - 5 min. | Appearance 1A - 5 min. | Appearance 2A - 2.5 min. | Bubbling test* (Height of froth after 10 min:) cm |
|---|---|---|---|---|---|
| 14 | O | O | O | Δ | 1.2 |
| 15 | ⊙ | ⊙ | ⊙ | ⊙ | 0.5 |
| 16 | ⊙ | ⊙ | ⊙ | ⊙ | 0.8 |
| 17 | ⊙ | ⊙ | ⊙ | ⊙ | 0.5 |
| 18 | O | O | O | ⊙ | 0.5 |
| 19 | ⊙ | ⊙ | ⊙ | ⊙ | 1.0 |
| 20 | O | ⊙ | O | Δ | 1.5 |
| 21 | O | ⊙ | ⊙ | ⊙ | 0.5 |
| 22 | O | ⊙ | ○ ⊙ | ⊙ | 0.5 |
| 23 | ⊙ | ⊙ | ⊙ | ⊙ | 0.5 |
| 24 | O | ⊙ | ⊙ | O | 2.0 |
| 25 | O | ⊙ | ⊙ | O | 1.5 |

⊙: excellent, O: good, Δ: permissible,
X: unsatisfactory
*Bubbling test

It consists of introducing 40 m of the plating solution into a 100 m plugged graduated cylinder, vigorously stirring the cylinder for 5 seconds and measuring the height of the froth produced.

What I claimed is:

1. A tin, lead or tin-lead alloy plating bath, which comprises:

(A) a principal plating bath containing an alkanesulfonic or alkanolsulfonic acid, and either a divalent tin salt or a divalent lead salt thereof or both;

(B) a surfactant selected from the group consisting of (a) a cationic surfactant selected from the group consisting of quaternary ammonium salts, alkyl pyridinium salts, alkyl imidazolinium salts and higher alkyl amine salts, (b) an amphoteric surfactant selected from the group consisting of betaines, and (c) a nonionic surfactant selected from the group consisting of condensation products of ethylene oxide and/or propylene oxide with a styrenated phenol, a higher alcohol, an alkyl phenol, an alkyl naphthol, a fatty acid amide, a sorbitan and a phosphate; and (C) a levelling agent selected from the group consisting of alkylidene sulfamic acids, quinolinol derivatives, benzotriazole derivatives, dialkylidene o-phenylene diamines, benzaldehyde derivatives, triazine derivatives, salicylic acid derivatives and nitriles.

2. A tin, lead or tin-lead alloy plating bath, which comprises:

(A) a principal plating bath containing an alkanesulfonic or alkanolsulfonic acid, and either a divalent tin salt or a divalent lead salt thereof or both;

(B) a nonionic surfactant selected from the group consisting of condensation products of ethylene oxide and/or propylene oxide with a styrenated phenol, a higher alcohol, an alkyl phenol, an alkyl naphthol, a fatty acid amide, a sorbitan and a phosphate; and (C) a levelling agent selected from the group consisting of alkylidene sulfamic acids, quinolinol derivatives, benzotriazole derivatives, dialkylidene o-phenylene diamines, benzaldehyde derivatives, triazine derivatives, salicylic acid derivatives and nitriles.

3. The plating bath according to claim 2, in which said surfactant further comprises a surfactant selected from the group consisting of quaternary ammonium salts, alkyl pyridinium salts, alkyl imidazolinium salts, higher alkyl amine salts and betaines.

4. The plating bath according to claim 3, in which said surfactant comprises a quaternary ammonium salt having the general formula I:

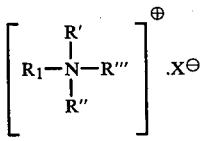

(I)

wherein X represents a halogen, a hydroxyl group, or the residue of a $C_{1-5}$ alkanesulfonic acid; $R_1$ represents a $C_{8-20}$ alkyl group; R′ and R″ represent a $C_{1-4}$ alkyl group; and R‴ represents a $C_{1-10}$ alkyl group or a benzyl group.

5. The plating bath according to claim 3, in which said surfactant comprises an alkyl pyridinium salt having the general formula II:

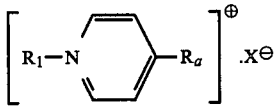

(II)

wherein X represents a halogen, a hydroxyl group or the residue of a $C_{1-5}$ alkanesulfonic acid; $R_1$ represents a $C_{8-20}$ alkyl group; and $R_a$ represents hydrogen or a $C_{1-4}$ alkyl group.

6. The plating bath according to claim 3, in which said surfactant comprises an imidazolinium salt having the general formula III:

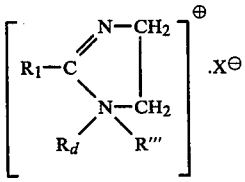

(III)

wherein X represents a halogen, a hydroxyl group, or the residue of a $C_{1-10}$ alkanesulfonic acid; $R_1$ represents a $C_{8-20}$ alkyl group; $R_d$ represents a hydroxy-containing $C_{1-5}$ alkyl group; and R‴ represents a $C_{1-10}$ alkyl group or a benzyl group.

7. The plating bath according to claim 3, in which said surfactant comprises a higher alkyl amine salt having the general formula IV:

$$[R_1—NH_3]^{\oplus}.CH_3—(CH_2)_n—COO^{\ominus} \quad \text{(IV)}$$

wherein $R_1$ represents a $C_{8-20}$ alkyl group; and n stands for an integer of 0 to 4.

8. The plating bath according to claim 3, in which said surfactant comprises a betaine having the general formula V:

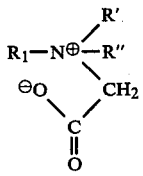

(V)

wherein $R_1$ represents a $C_{8-20}$ alkyl group; R′ and R″ represents a $C_{1-4}$ alkyl group.

9. The plating bath according to claim 2, in which said surfactant comprises a condensation product of ethylene oxide and/or propylene oxide with a styrenated phenol having the general formula VI:

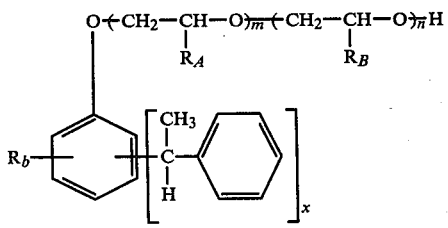

(VI)

wherein $R_A$ and $R_B$ represent hydrogen or —$CH_3$ with the proviso that $R_B$ represents —$CH_3$ when $R_A$ represents hydrogen, and vice versa; $R_b$ represents hydrogen, a $C_{1-4}$ alkyl group, or a phenyl group; m is an integer of 1 to 25; n is an integer of 0 to 25; and x is an integer of 1 to 3.

10. The plating bath according to claim 2, in which said surfactant comprises a condensation product of ethylene oxide and/or propylene oxide with a higher alcohol having the general formula VII:

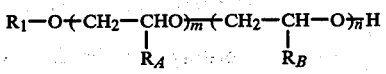

(VII)

wherein $R_1$ represents a $C_{8-20}$ alkyl group; $R_A$ and $R_B$ represent hydrogen or —$CH_3$, with the proviso that $R_B$ represents —$CH_3$ when $R_A$ represents hydrogen, and vice versa; m is an integer of 1 to 25 and n is an integer of 0 to 25.

11. The plating bath according to claim 2, in which said surfactant comprises a condensation product of ethylene oxide and/or propylene oxide with an alkyl phenol having the general formula VIII:

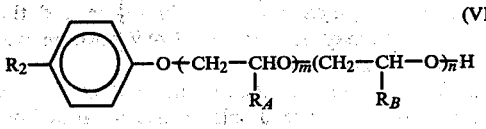

(VIII)

wherein $R_2$ represents a $C_{1-20}$ alkyl group; $R_A$ and $R_B$ represent hydrogen or —$CH_3$, with the proviso that $R_B$ represents —$CH_3$ when $R_A$ represents hydrogen, and vice versa; m is an integer of 1 to 25 and n is an integer or 0 to 25.

12. The plating bath according to claim 2, in which said surfactant comprises a condensation product of ethylene oxide and/or propylene oxide with an alkyl naphthol having the general formula IX:

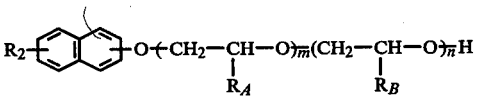

IX)

wherein $R_2$ represents a $C_{1-20}$ alkyl groupl $R_A$ and $R_B$ represent hydrogen or —$CH_3$, with the proviso that $R_B$ represents —$CH_3$ when $R_A$ represents hydrogen, and vice versa; m is an integer of 1 to 25 and n is an integer of 0 to 25.

13. The plating bath according to claim 2, in which said surfactant comprises a condensation product of ethylene oxide and/or propylene oxide with a phosphate having the general formula X:

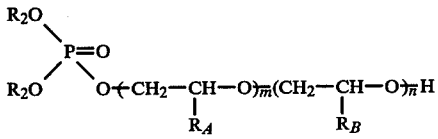

(X)

wherein $R_2$ represents a $C_{1-20}$ alkyl group, one of which may be hydrogen; $R_A$ and $R_B$ represent hydrogen or —$CH_3$, with the proviso that $R_B$ represents —$CH_3$ when $R_A$ represents hydrogen, and vice versa; m is an integer of 1 to 25 and n is an integer of 0 to 25.

14. The plating bath according to claim 2, in which said surfactant is used in a concentration of 0.01 to 50 grams per liter of said bath.

15. The plating bath according to claim 2, in which said levelling agent comprises an alkylidene sulfamic acid having the general formula A:

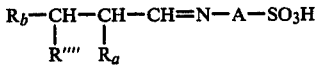

(A)

wherein $R_b$ represents hydrogen, a $C_{1-4}$ alkyl or phenyl group; R'''' represents hydrogen or a hydroxyl group; A represents a single bond or a phenylene group; and $R_a$ represents hydrogen or a $C_{1-4}$ alkyl group.

16. The plating bath according to claim 2, in which said levelling agent comprises a quinolinol derivative having the general formula B:

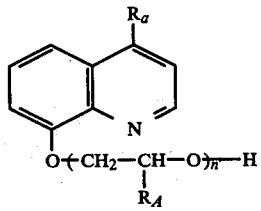

(B)

wherein $R_a$ represents hydrogen or a $C_{1-4}$ alkyl group; $R_A$ represents hydrogen or —$CH_3$; and n' is an integer of 2 to 15.

17. The plating bath according to claim 2, in which said levelling agent comprises a benzotriazole derivative having the general formula C:

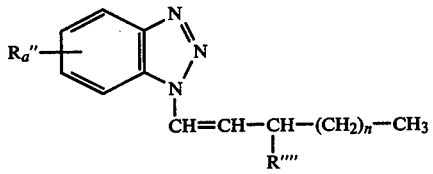

(C)

wherein $R''_a$ represents hydrogen, a halogen or a $C_{1-4}$ alkyl group; R'''' represents hydrogen or a hydroxyl group; and n is an integer of 0 to 12.

18. The plating bath according to claim 2, in which said levelling agent comprises a dialkylidene o-phenylene diamine having the general formula D:

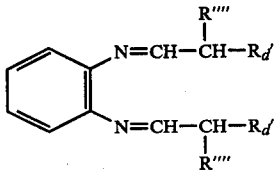

(D)

wherein R'''' represents hydrogen or a hydroxyl group; and $R'_d$ represents a $C_{1-5}$ alkyl or hydroxyl-containing $C_{1-5}$ alkyl group.

19. The plating bath according to claim 2, in which said levelling agent comprises a benzaldehyde derivative having the general formula E:

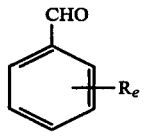

(E)

wherein $R_e$ represents a nitro, amino, or $C_{1-5}$ alkyl group.

20. The plating bath according to claim 2, in which said levelling agent comprises a triazine derivative having the general formula F:

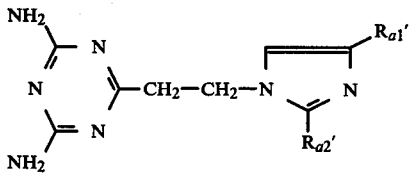

(F)

wherein $R'_{a1}$ represents hydrogen or a $C_{1-10}$ alkyl group, and $R'_{a2}$ represents a $C_{1-18}$ alkyl group.

21. The plating bath according to claim 2, in which said levelling agent comprises a salicylic acid derivative having the general formula G:

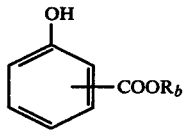

(G)

wherein $R_b$ represents hydrogen, a $C_{1-4}$ alkyl group, or a phenyl group.

22. The plating bath according to claim 2, in which said levelling agent comprises a nitrile having the general formula H:

$$R'_b—CH=CH—C\equiv N \quad \text{(H)}$$

wherein $R'_b$ represents hydrogen, a phenyl group, or a $C_{1-8}$ alkyl group.

23. The plating bath according to claim 2, in which said levelling agent is used in a concentration of 0.01 to 30 grams per liter of said bath.

24. The plating bath according to claim 2, in which said alkanesulfonic acid and alkanolsulfonic acid have the general formulas, respectively:

$$R—SO_3H$$

where R represents a $C_{1-12}$ alkyl group, and $$HO—R—SO_3H$$

where R represents a $C_{1-12}$ alkyl group and the hydroxyl group may be situated in any position with respect to the alkyl group.

25. The plating bath according to claim 2, in which said tin salt and/or lead salt of said alkanesulfonic or alkanolsulfonic acid is used in a concentration in terms of metal of 0.5 to 200 grams per liter of said bath.

26. The plating bath according to claim 2, in which the concentration of the free alkanesulfonic or alkanolsulfonic acid is at least stoichiometrically equivalent to the bivalent tin and/or lead ions.

* * * * *